US006533281B1

(12) United States Patent
Kumagai

(10) Patent No.: US 6,533,281 B1
(45) Date of Patent: Mar. 18, 2003

(54) PLAYING MACHINE

(75) Inventor: Naoji Kumagai, Tokyo (JP)

(73) Assignee: Sammy Corporation, Tokyo (JP)

( * ) Notice: Subject to any disclaimer, the term of this patent is extended or adjusted under 35 U.S.C. 154(b) by 0 days.

(21) Appl. No.: 09/787,568

(22) PCT Filed: Jul. 25, 2000

(86) PCT No.: PCT/JP00/04947

§ 371 (c)(1),
(2), (4) Date: Mar. 19, 2001

(87) PCT Pub. No.: WO01/07129

PCT Pub. Date: Feb. 1, 2001

(30) Foreign Application Priority Data

Jul. 27, 1999 (JP) ..... 11-211473

(51) Int. Cl.[7] ..... A63H 33/26

(52) U.S. Cl. ..... 273/442; 446/129; 273/443; 463/61; 463/68

(58) Field of Search ..... 446/129, 130, 446/131, 132, 133, 134, 135, 136, 137, 138, 139; 463/61, 68; 273/108.1, 126 A, 443, 442

(56) References Cited

U.S. PATENT DOCUMENTS

| | | | | | |
|---|---|---|---|---|---|
| 4,231,571 | A | * | 11/1980 | Watanabe | 273/441 |
| 4,453,712 | A | | 6/1984 | Lee | |
| 4,881,917 | A | * | 11/1989 | Suzuki et al. | 446/129 |
| 4,990,117 | A | * | 2/1991 | Yonezawa | 446/129 |
| 5,016,878 | A | * | 5/1991 | Hay et al. | 273/108.51 |
| 5,346,398 | A | | 9/1994 | Nakahata et al. | |
| 5,501,455 | A | | 3/1996 | Hirata et al. | |
| 5,915,853 | A | * | 6/1999 | Guilin | 40/414 |
| 6,062,938 | A | * | 5/2000 | Meng-Suen | 40/426 |
| 6,322,415 | B1 | * | 11/2001 | Cyrus et al. | 446/130 |

FOREIGN PATENT DOCUMENTS

| | | |
|---|---|---|
| JP | 04-092690 | 3/1992 |
| JP | 4-29674 | 7/1992 |
| JP | 560392 | 9/1993 |

* cited by examiner

*Primary Examiner*—Jacob K. Ackun
*Assistant Examiner*—Faye Francis
(74) *Attorney, Agent, or Firm*—Wolf, Greenfield & Sacks, P.C.

(57) ABSTRACT

A playing machine making a player feel as if a car is running by moving a mobile body modeling a car shape on the surface of a circulating endless belt, wherein front wheels mounted on the mobile body are turned in a moving direction by a relatively simple mechanism.

The mobile body 40 comprises a body 50, the front wheels 43 which are mounted so as to face toward the front both sides of the body 50 and which can swing around steering shafts 70 perpendicular to the obverse surface of the endless belt 20 and a wheel arm 46 to which the both front wheels 43 are connected at positions forward from the steering shafts 70 and which is formed to be movable according to the swing of the front wheels 43 around the steering shafts 70. Moreover, and the obverse-side attraction means 86 is fitted to the wheel arm 46 and is formed to be movable together with the wheel arm 46.

17 Claims, 12 Drawing Sheets

PLAYING MACHINE

FIELD OF THE INVENTION

The present invention relates to a playing machine. It relates more particularly to a playing machine making a player feel as if an automobile is running by moving a mobile body modeling an automobile shape transversely on the obverse surface of a circulating endless belt. It further relates to a playing machine wherein front wheels fitted to the mobile body turn to their moving direction.

BACKGROUND OF THE INVENTION

Conventionally, there has been provided a playing machine making a player feel as if an automobile is running by moving a mobile body modeling an automobile shape transversely on the obverse surface of a circulating endless belt.

Such a playing machine comprises an endless belt, a guide body and the mobile body.

The above-mentioned endless belt is formed so that it may circulate. Further, on the obverse surface of the endless belt is painted a picture illustrated a road and the like.

Further, the above-mentioned guide body is installed on the reverse side of the endless belt which positions above the guide body, and is formed to move transversely when a player turns a steering wheel. Further, in an upper portion of the guide body is mounted reverse-side attraction means by a magnetic force.

Further, the above-mentioned mobile body is formed to model an automobile shape and is placed on the obverse surface of the endless belt. Further, in a lower portion of the mobile body is mounted obverse-side attraction means which attracts the reverse-side attraction means mounted in the above-mentioned guide body each other by a magnetic force.

Still further, since both the reverse-side attraction means mounted in the guide body and the obverse-side attraction means mounted in the mobile body attract each other by a magnetic force, both the guide body and the mobile body attract each other through the endless belt.

Then, when the player turns the steering wheels to move the guide body transversely, the mobile body moves transversely on the obverse surface of the endless belt according to the movement of the guide body. Accordingly, it seems as if an automobile is actually running.

By the way, in order to increase the reality in the movement of the mobile body, such a playing machines is sometimes formed to make its two front wheels fitted to the mobile body turn to their moving direction as well as an actual automobile.

There has been, however, some problems in the above-mentioned mechanism by which the front wheels turns to their moving direction.

Concretely, the mechanism by which both wheels turn to their moving direction sometimes uses a power source such as a motor. However, the electric cords, which are necessary for supplying electric power to the power source or for controlling the power source, are not of good appearance.

Further, the mechanism by which both wheels turn to their moving direction needs so many constituent parts that it raises the manufacturing cost of the whole playing machine.

Accordingly, a playing machine in the present invention comprises a wheel arm to which both front wheels are connected at positions forward from steering shafts and which moves according to the swing of the front wheels around the steering shafts. The wheel arm is also connected with obverse-side attraction means. Thus, when the reverse-side attraction means moves, the obverse-side attraction means and the wheel arm first move according to the movement of the reverse-side attraction means. At the same time, both front wheels so swing that they turn in their moving direction. Accordingly, the whole mobile body can move according to the movement of the reverse-side attraction means. In this way, it is an object of the present invention to provide a playing machine in which both front wheels can turn in their moving direction without using so many parts.

DISCLOSURE OF THE INVENTION

The present invention is related to a playing machine comprising a circulating endless belt (20), a guide body (30) which is provided at the reverse side of the endless belt (20) and which is formed to be movable upon the operation by a player, and a mobile body (40) which is placed on the obverse surface of the endless belt (20) and which is formed to model an automobile shape; wherein reverse-side attraction means (31) by a magnetic force is mounted at a side of the guide body (30) near to the mobile body (40); obverse-side attraction means (86) by a magnetic force is mounted at a side of the mobile body (40) near to the guide body (30); both the reverse-side attraction means (31) mounted in the guide body (30) and the obverse-side attraction means (86) mounted in the mobile body (40) are formed to attract each other through the endless belt (20); the mobile body (40) is formed to be movable on the obverse surface of the endless belt (20) according to the movement of the guide body (30) upon the operation by the player; the mobile body (40) comprises a body (50), front wheels (43) which are fitted so as to face toward the front both sides of the body (50) and which can swing around steering shafts (70) perpendicular to the obverse surface of the endless belt (20) and a wheel arm (46) to which the both front wheels (43) are connected at positions forward from the steering shafts (70) and which is formed to be movable according to the swing of the front wheels (43) around the steering shafts (70); and the obverse-side attraction means (86) is fitted to the wheel arm (46) and is formed to be movable together with the wheel arm (46).

Here, the "endless belt (20)" means a belt whose both ends are bonded to each other to form an annular shape. The endless belt (20) can usually keep its proper tension to circulate by means of one driving roller (21), one guide roller (22) or more and one tension roller (23) or more. An outside surface of the endless belt (20) is regarded as an "obverse surface" and an inner surface a "reverse surface". Further, on the surface of the endless belt (20) is usually painted a picture illustrating a road or the like, and the road appears to change from moment to moment according to the circulating movement of the endless belt (20).

Further, the "guide body (30)" means a device which indirectly moves the mobile body (40). The guide body (30) is provided at the reverse side of the endless belt (20) and is formed so as to be movable upon the operation of the player. Further, the reverse-side attraction means (31) is mounted at a side of the guide body (30) near to the mobile body (40).

Further, the "reverse-side attraction means (31)" is means which attracts the obverse-side attraction means (86) each other by a magnetic force and is made of a magnet or a magnetic substance. Further, the magnet may be a permanent magnet or an electric magnet.

Further, the "mobile body (40)" means a device which is placed on the obverse surface of the endless belt (20) and is formed to be movable on the obverse surface of the endless belt (20). The obverse-side attraction means (86) is mounted at a side of the mobile body near to the guide body (30). Further, the mobile body (40) models an automobile shape and comprises the body (50), the front wheels (43), the wheel arm (46) and so on.

Further, the "obverse-side attraction means (86)" is means which attracts the reverse-side attraction means (31) each other by a magnetic force and is made of a magnet or a magnetic substance. Further, the magnet may be a permanent magnet or an electric magnet.

Then, since the reverse-side attraction means (31) and the obverse-side attraction means (86) attract each other by a magnetic force, the guide body (30) and the mobile body (40) attract each other through the endless belt (20).

By the way, it is necessary for either or both of the reverse-side attraction means (31) and the obverse-side attraction means (86) to be made of a magnet in order that the both of them attract each other by a magnetic force.

Further, the "body (50)" means a part corresponding to a body of an actual automobile. The body (50) comprises, for example, an upper body (41) and a base frame (42).

Further, the "front wheels (43)" are wheels which are fitted so as to face toward the front both sides of the body (50) and which can swing around the "steering shafts (70)" perpendicular to the obverse surface of the endless belt (20). The front wheels (43) are also formed so that they may rotate around "axles (68)" parallel to the obverse surface of the endless belt (20).

That is, each front wheel (43) is formed so that it may swing clockwise or counter-clock wise around the steering shafts (70) in a plan view of the body (50) and that it may rotate clockwise or counter-clockwise around the axles (68) in a side view of the body (50).

Further, the "wheel arm (46)" means a component to which both-front wheels (43) are connected at positions forward from the steering shafts (70) and which moves together with both front wheels (43).

For example, when both front wheels (43) are fitted to the body (50) through the steering shafts (70) and the hubs (45) with the axles (68), both front wheels (43) may be connected by fitting the wheel arm (46) to the hubs (45). Then, when the wheel arm (46) moves to the right, both front wheels (43) turn to the right. On the other hand, when the wheel arm (46) moves to the left, both front wheels (43) turn to the left.

Further, by connecting the above-mentioned obverse-side attraction means (86) to the wheel arm (46), when the reverse-side attraction means (31) moves, the obverse-side attraction means (86) and the wheel arm (46) first moves according to the movement of the reverse-side attraction means (31) and simultaneously both front wheels (43) turn to their moving direction. Thereafter, the whole mobile body (40) moves according to the movement of the reverse-side attraction means (31).

For example, when the reverse-side attraction means (31) moves to the right, the obverse-side attraction means (86) and the wheel arm (46) first moves to the right according to the movement of the reverse-side attraction means (31) and simultaneously both front wheels (43) turn to the right. Thereafter, the whole mobile body (40) moves to the right according to the reverse-side attraction means (31) due to the relative advance of the mobile body (40) to the circulating endless belt (20).

In this way, by providing with the wheel arm (46) to which the both front wheels (43) are connected at positions forward from the steering shafts (70) and which is formed to be movable according to the swing of the front wheels (43) and by connecting the obverse-side attraction means (86) to the wheel arm (46), it is possible for both front wheels (43) to turn to their moving direction without using so many parts.

BEST MODE FOR CARRYING OUT THE INVENTION

Figure 1:
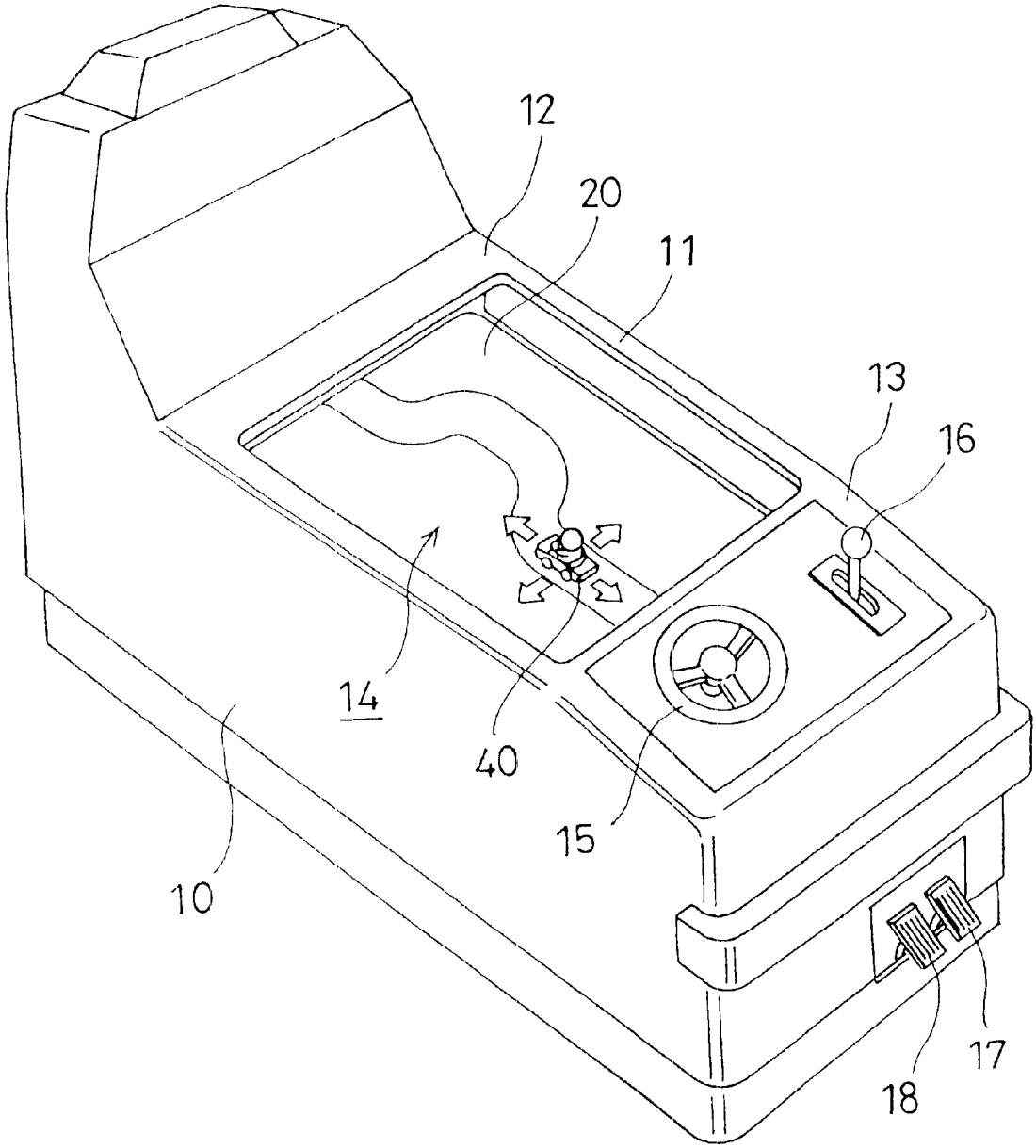
FIG. 1 is a perspective view showing an outer appearance of a playing machine according to an embodiment of the present invention.

An embodiment of a playing machine according to the present invention is explained in conjunction with an example shown in figures. The playing machine according to the present embodiment is a playing machine making a player as if an automobile is running by moving a mobile body 40 modeling an automobile shape longitudinally and transversely on a obverse surface of a circulating endless belt 20.

The playing machine comprises a circulating endless belt 20, a guide body 30 which is provided at the reverse side of the endless belt 20 and which is formed to be movable upon the operation by a player, and a mobile body 40 which is placed on the obverse surface of the endless belt 20 and which is formed to model an automobile shape.

Reverse-side attraction means 31 by a magnetic force is mounted at a side of the above-mentioned guide body 30 near to the mobile body 40 and obverse-side attraction means 86 by a magnetic force is mounted at a side of the above-mentioned mobile body 40 near to the guide body 30. Then, since both the reverse-side attraction means 31 mounted in the guide body 30 and the obverse-side attraction means 86 mounted in the mobile body 40 are formed to attract each other through the endless belt 20, the mobile body 40 is formed to move on the obverse surface of the endless belt 20 according to the movement of the guide body 30 upon the operation by the player.

Further, the above-mentioned mobile body 40 comprises a body 50, front wheels 43 which are fitted so as to face toward the front both sides of the body 50 and which can swing around steering shafts 70 perpendicular to the obverse surface of the endless belt 20 and a wheel arm 46 to which the both front wheels 43 are connected at positions forward from the steering shafts 70 and which is formed to be movable according to the swing of the front wheels 43 around the steering shafts 70.

Further, the above-mentioned obverse-side attraction means 86 is fitted to the wheel arm 46 and is formed to be movable together with the wheel arm 46.

Accordingly, when the reverse-side attraction means 31 moves, the obverse-side attraction means 86 and the wheel arm 46 first moves according to the movement of the reverse-side attraction means 31 and simultaneously both front wheels 43 turn to their moving direction. Thereafter, due to the circulating rotation of the endless belt 20 and the direction of both front wheels 43, the whole mobile body 40, which moves on the endless belt 20, moves according to the movement of the reverse-side attraction means 31.

In this way, the playing machine is so formed that the both front wheels turn to their moving direction without using so many parts.

The playing machine is further described in detail hereinafter.

The playing machine comprises the endless belt 20, the guide body 30 and the mobile body 40 inside its casing 10.

Casing 10

As shown in FIG. 1, an upper surface panel 11 is mounted on an upper surface of the casing 10.

The upper surface panel 11 inclines to lower its near side to the player.

Further, this upper surface panel 11 is divided into two parts: a slightly-inclined part 12 from a far side to a midway of the upper surface panel 11 with a relatively slight inclination and a largely-inclined part 13 from the midway to the near side with a relatively large inclination.

The above-mentioned slightly-inclined part 12 is provided with a transparent top window 14 through which the player can visually recognize the endless belt 20 and the mobile body 40 placed on the obverse surface of the endless belt 20 disposed inside the casing 10.

Further, the above-mentioned largely-inclined part 13 is provided with a steering wheel 15 and a shift lever 16.

Further, in a lower portion of a front surface of the casing 10, an acceleration pedal 17 and a breaking pedal 18 are formed.

Endless Belt 20

Further, the above-mentioned endless belt 20 is formed to circulate while keeping a proper tension by means of some rollers disposed inside the above-mentioned casing 10 with rotary axes along the transverse direction of the casing 10.

Figure 2:
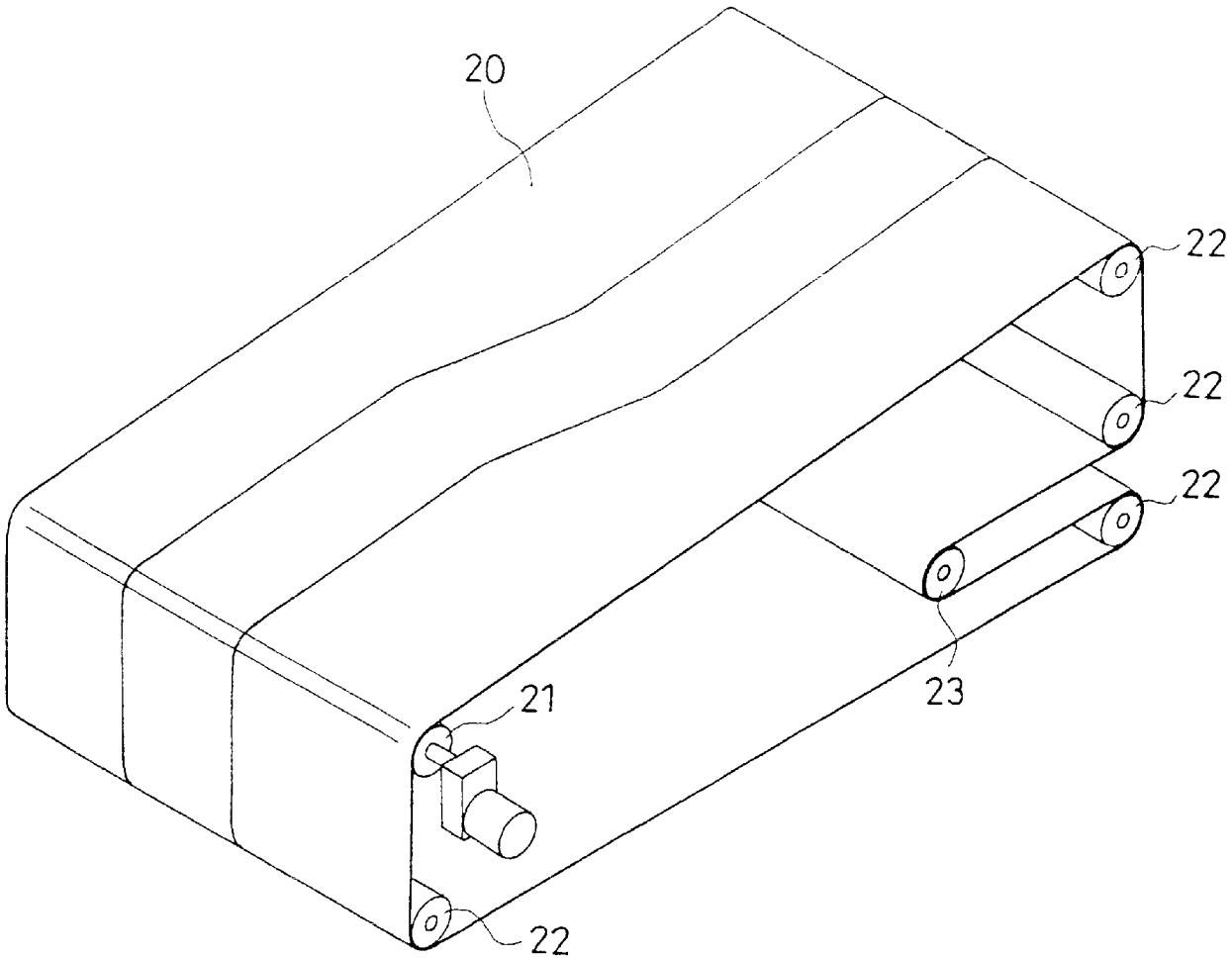
FIG. 2 is a perspective view showing a driving mechanism of an endless belt.

Concretely, as shown in FIG. 2, a driving roller 21 with a driving mechanism is installed at an upper part of the near side in the casing 10. Further, guide rollers 22 are respectively installed at a lower part of the near side, at an upper part of the far side, at a lower part of the far side, and around a middle part of the far side in the casing 10. Further, at a level between the guide rollers 22 at the lower part and around the middle part of the far side, and in the position slightly nearer to the near side from these two guide rollers 22, a tension roller 23 which keeps the tension of the endless belt 20 is installed. Then, when the driving roller 21 rotates by the driving mechanism, the endless belt 20 circulates according to the rotation of the driving roller 21. Further, the respective guide rollers 22 and the tension roller 23 rotate according to the circulation of the endless belt 20. Here, although respective guide rollers 22 rotate in the same direction as the rotation of the driving roller 21, only the tension roller 23 rotates in the direction inverse to the rotation of the driving roller 21.

Further, the driving mechanism rotates rapidly when the player either changes over the shift lever 16 to a high speed mode or steps in the acceleration pedal 17. On the other hand, the driving mechanism rotates slowly when the player either changes over the shift lever 16 to a low speed mode or steps in the breaking pedal 18. Accordingly, the endless belt 20 circulates rapidly or slowly.

Moreover, on the obverse surface of the endless belt 20 is painted a picture illustrating a road and the like. Accordingly, as the endless belt 20 circulates counter-clockwise in a right side view of the casing 10, the road and the like painted on the obverse surface of the endless belt 20 change from moment to moment. Accordingly, it appears as if the mobile body 40 modeling an automobile shape is actually running.

Guide Body 30

Further, the above-mentioned guide body 30 is installed in the reverse side of an upper portion of the endless ring-shaped endless belt 20 and is formed move longitudinally and transversely upon the operation of the steering wheel 15 or the like by the player.

Concretely, when the player turns the steering wheel 15 clockwise, the guide body 30 moves to the right; when the player turns the steering wheel 15 counter-clockwise, the guide body 30 moves to the left. Further, when the player steps in the acceleration pedal 17, the guide body 30 moves forward; when the player steps in the breaking pedal 18, the guide body 30 moves backward.

Figure 3:
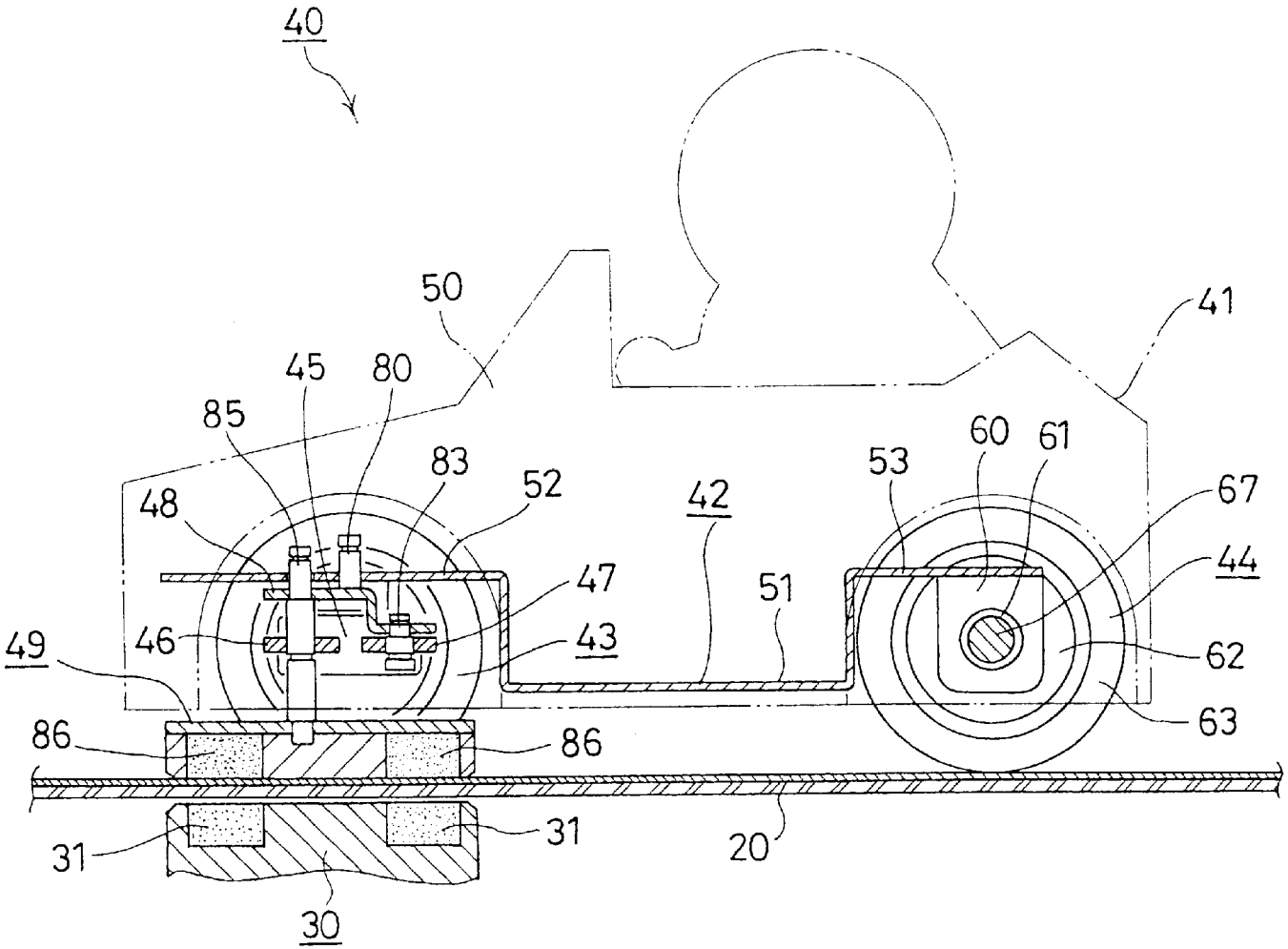
FIG. 3 is a side cross-sectional view showing essential parts of a mobile body and a guide body.

Further, as shown in FIG. 3, some magnets as the reverse-side attraction means 31 are mounted in an upper portion of the guide body 30.

Mobile Body 40

Further, as shown in FIG. 3, the above-mentioned mobile body 40 has a shape modeling an automobile and is placed on the obverse surface of the endless belt 20.

The mobile body 40 comprises the upper body 41, the base frame 42, the front wheels 43, rear wheels 44, the hub 45, the wheel arm 46, an auxiliary wheel arm 47, an arm joint 48, and an underbase 49.

Upper Body 41

The above-mentioned upper body 41 is a part corresponding to an upper body of an actual automobile and is integrally formed of plastics.

Base Frame 42

Figure 4A:
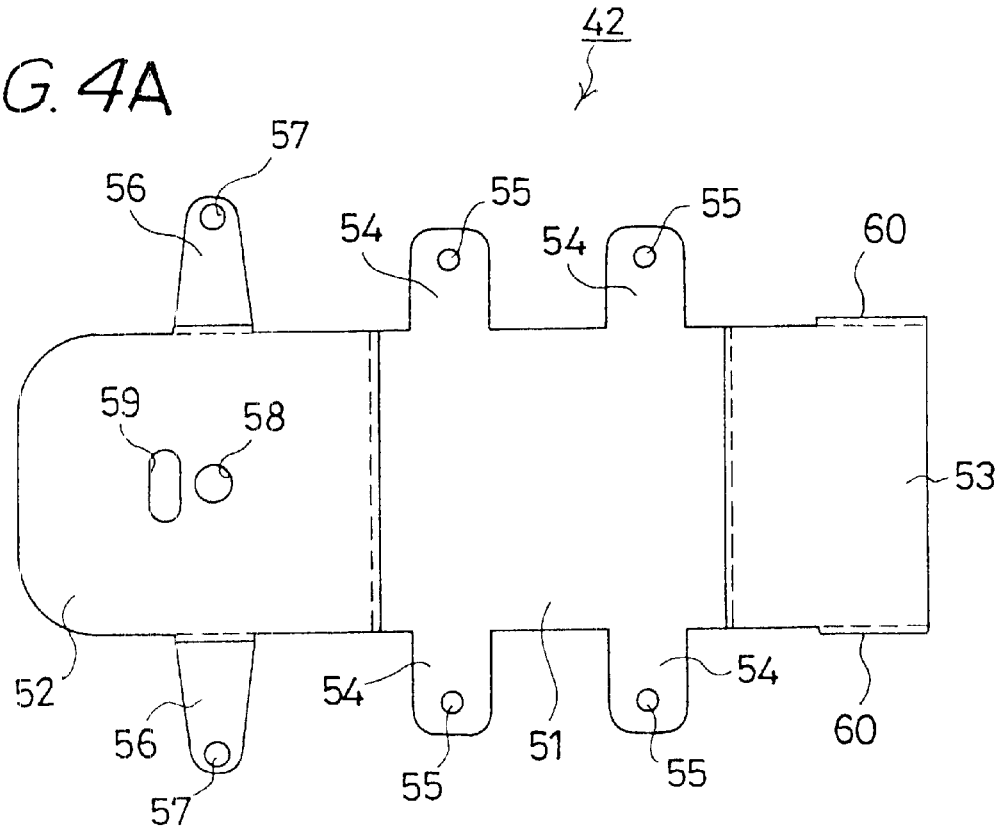
FIG. 4 contains a plan view (A) and a side view (B) of a base frame.
Figure 4B:
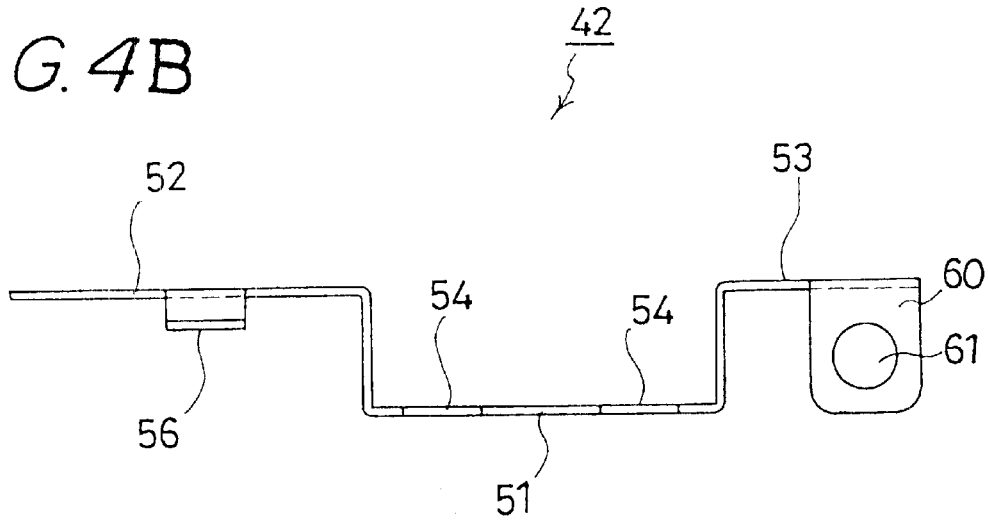
Figure 5A:
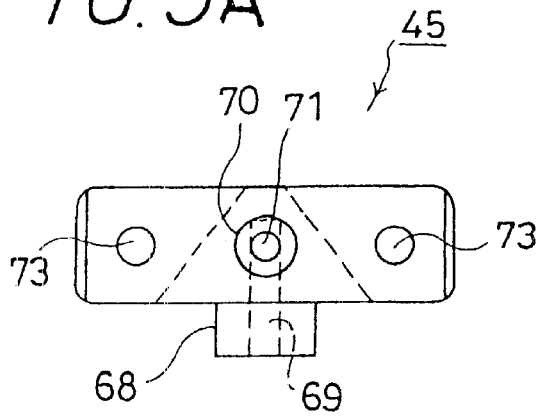
FIG. 5 contains a plan view (C) and a side view (D) of a hub, a cross-sectional view (E) taken along a line X-X in (D) and a cross-sectional view (F) taken along a line Y-Y in (D).
Figure 5B:
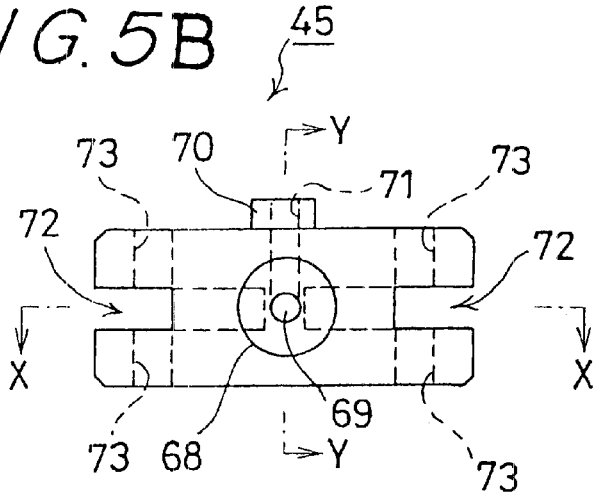
Figure 5D:
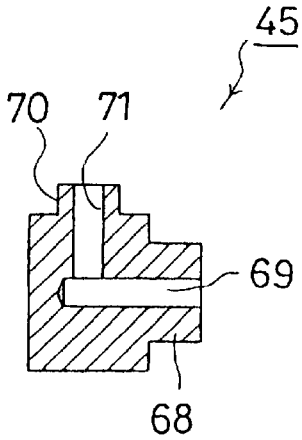
Figure 5C:
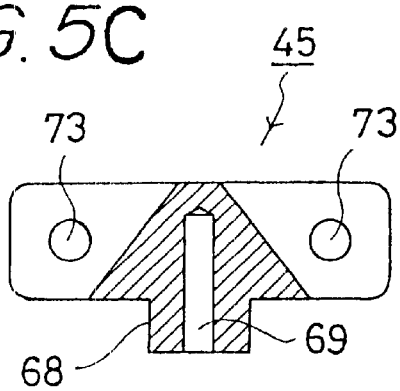

Further, the above-mentioned base frame 42 comprises, as shown in FIGS. 4A and 4B, a planar-shaped base part 51, a front-wheel-fitted part 52 contiguously formed in a front part of the base part 51 and a rear-wheel-fitted part 53 contiguously formed in a rear part of the base part 51.

Four body-fitted lugs 55 are formed in the base part 51. The body-fitted lugs 55 are formed in a planer shape and protrude outward from both sides of the base part 51. Further, a circular body-fitted hole is formed in each body-fitted lug 55. Accordingly the above-mentioned upper body 41 is fixed to the base frame 42 with body-fitting pins through the body-fitted holes.

Namely, the body 50 is constituted by the base frame 42 and the above-mentioned upper body 41.

Further, two front-wheel-fitted lugs 56, an arm-joint-fitted hole 58 and a transversely-elongated hole 59 are formed on the above-mentioned front-wheel-fitted part 52. The front-wheel-fitted lugs 56 are formed in a planer shape and protrude outward from both sides of the front-wheel-fitted part 52. Further, a circular steering-shaft-fitted hole 57 are formed in each front-wheel-fitted lug 56. Further, the arm-joint-fitted hole 58 is formed in the approximately center of the front-wheel-fitted part 52 and is formed in a circular shape. Further, the transversely-elongated hole 59, formed in an oblong shape elongated transversely in the base frame 42, is disposed in the approximately center of the front-wheel-fitted part 52 and also forward from the above-mentioned arm-joint-fitted hole 58.

Further, two rear-wheel-fitted lugs 60 are formed on the above-mentioned rear-wheel-fitted part 53. The rear-wheel-fitted lugs 60 are formed in a planer shape and protrude downward from both sides of the rear-wheel-fitted part 53 below the base frame 42 to face each other. Further, a circular rear-wheel-fitted holes 61 are formed in each rear-wheel-fitted lugs 60.

Front Wheels 43 and Rear Wheels 44

Figure 8:
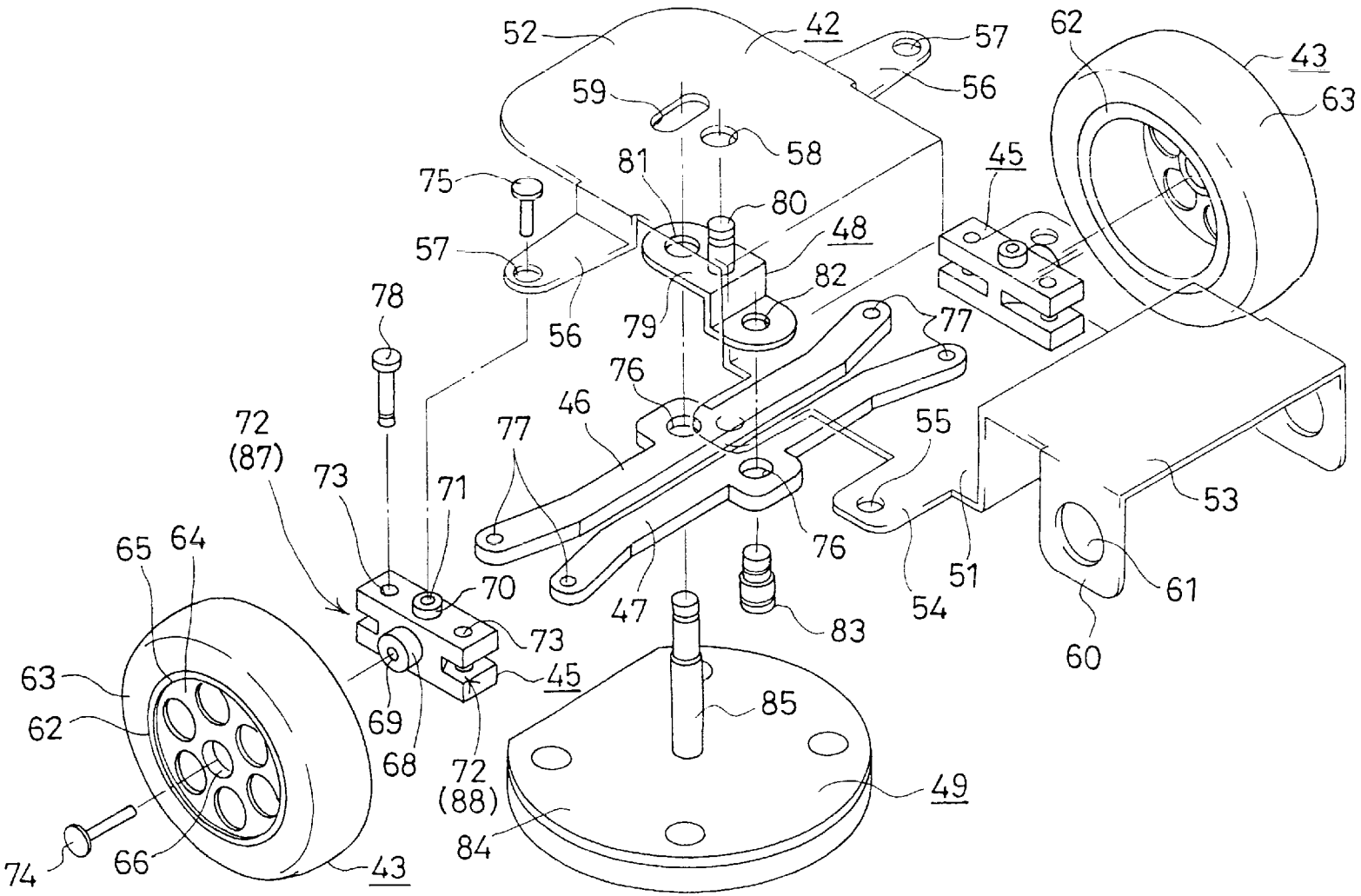
FIG. 8 is an exploded perspective view showing an essential part of the mobile body.

Further, the above-mentioned front wheel 43 is comprised of a wheel 62 and a tire 63 as shown in FIG. 8.

The above-mentioned wheel 62 includes a disc-shaped disc part 64 and a cylindrical rim part 65 contiguously connected to a periphery of the disc part 64. Further, a circular axle-fitted hole 66 is formed in the center of the disc part 64.

Then, the tire 63 is fitted to an outer periphery of the rim part 65 thus constituting the front wheel 43.

By the way, with respect to the rear wheel 44, the tire is fitted to an outer periphery of the rim part 65 of the wheel 62 with the disc part 64 and the rim part 65 as well as the front wheel 43.

Further, the rear wheels 44 are disposed at both sides of the rear-wheel-fitted parts 53 of the above-mentioned base frame 42 and are fitted to the base frame 42 by means of cylindrical-rod-shaped wheel shafts 67 through both rear-wheel-fitted holes 61 so that they can rotate.

The manner of fitting the front wheels 43 is explained later.

Hub 45

Further, as shown in FIGS. 5A–5D, the hub 45 is provided with an axle 68, an axle-center hole 69, a steering shaft 70, a steering-shaft-center hole 71, an arm-insertion groove 72 and an arm-fitted hole 73.

The above-mentioned axle 68 is formed into a cylindrical shape with an outer diameter approximately equal to an inner diameter of the above-mentioned axle-fitted hole 66. Further, the axle-center hole 69 is formed in the center of this axle 68.

Further, the above-mentioned steering shaft 70 is also formed into a cylindrical shape with an outer diameter approximately equal to an inner diameter of the above-mentioned steering-shaft-fitted hole 57. Further, the steering shaft 70 is disposed perpendicular to the axle 68. Moreover, a steering-shaft-center hole 71 is formed in the center of the steering shaft 70.

Further, above-mentioned arm-insertion grooves 72 are formed at both sides of the axle 68 and are formed parallel to the axle 68.

Further, the above-mentioned arm-fitted holes 73 are formed in both sides of the steering shaft 70 and are formed parallel to the steering shaft 70 to penetrate the arm-insertion grooves 72.

Figure 9:
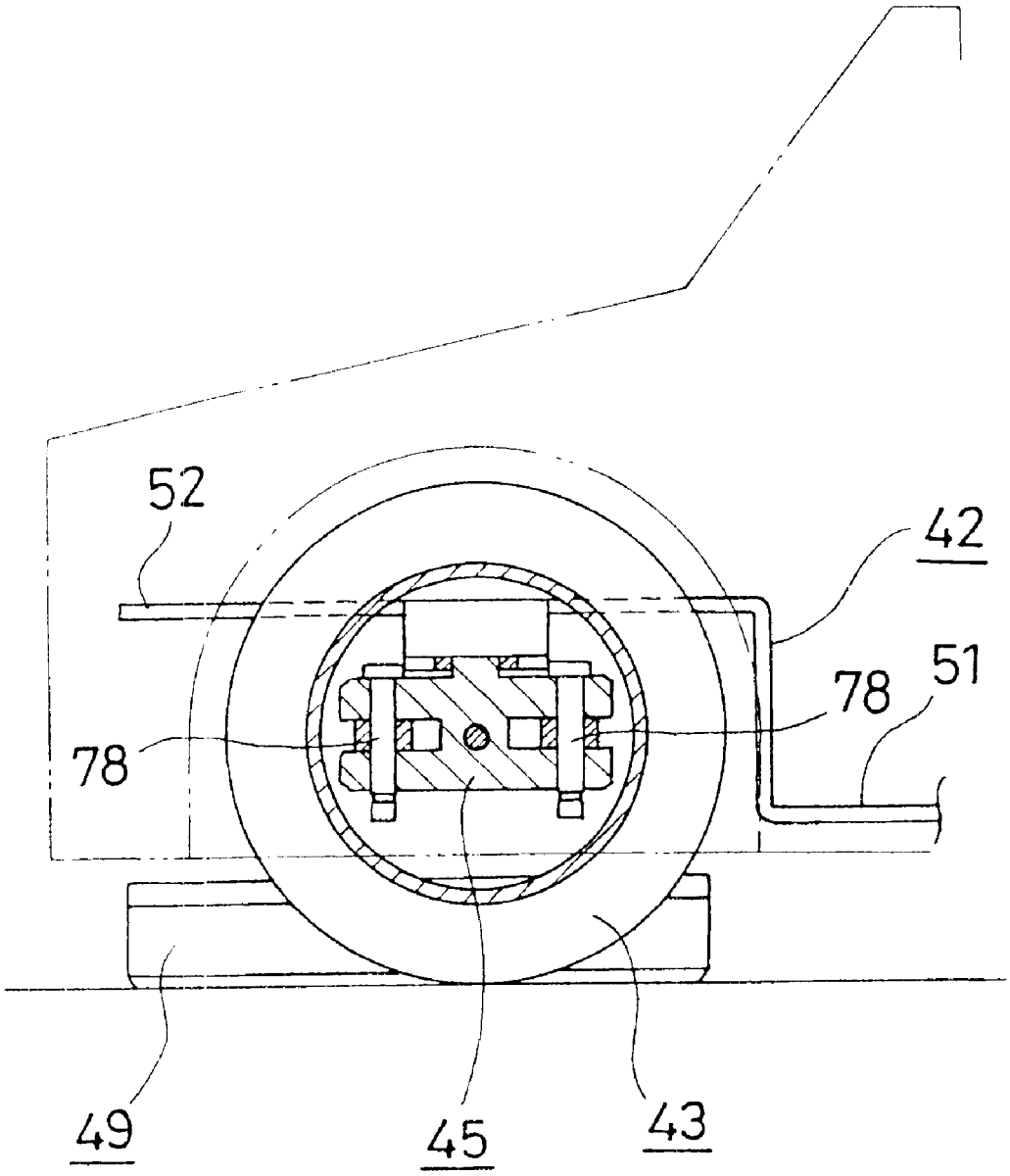
FIG. 9 is a side cross-sectional view showing an essential part of the mobile body.

Then, as shown in FIG. 8 and FIG. 9, the hub 45 is disposed at the inside of the rim part 65 of the front wheel 43 and is fitted to the front wheel 43 by inserting the axle 68 into the axle-fitted hole 66 and by simultaneously inserting an axle-fitting pin 74 into the axle-center hole 69 so that it can rotate.

Further, as shown in FIG. 8 and FIG. 9, the hubs 45 are arranged at both sides of the front-wheel-fitted part 52 of the above-mentioned base frame 42 and are fitted to the base frame 42 by inserting the steering shafts 70 into steering-shaft-fitted holes 57 and by simultaneously inserting steering-shaft-fitting pins 75 into the steering-shaft-center holes 71 so that they can rotate.

Accordingly, both front wheels 43 are fitted to both front side of the body 50 to face each other. Further, both front wheels 43 can swing clockwise or counter-clockwise around the steering shafts 70 in a plan view of the body 50, while both front wheels 43 can rotate clockwise or counter-clockwise around the axle 68 in a side view of the body 50.

Wheel Arm 46 and Auxiliary Wheel Arm 47

Figure 6:
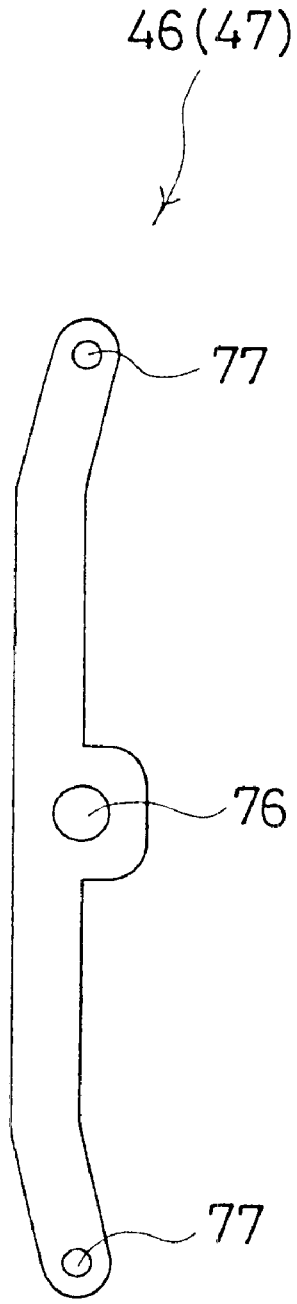
FIG. 6 is a plan view of a wheel arm (auxiliary wheel arm).

Further, as shown in FIG. 6, the above-mentioned wheel arm 46 and the auxiliary wheel arm 47 are formed in a flat bar shape and their lengths are made approximately equal to a distance between both hubs 45 fitted to the base frame 42. Further, circular center-connection holes 76 are formed approximately in the middle of the wheel arm 46 and the auxiliary wheel arm 47, while circular hub-connection holes 77 are formed in the vicinity of both ends of the wheel arm 46 and auxiliary wheel arm 47.

Then, the wheel arm 46 and the auxiliary wheel arm 47 are so fitted that they connect both hubs 45 fitted to the base frame 42.

Here, when the hub 45 is fitted to the base frame 42, the arm-insertion groove 72 forward from the steering shaft 70 is referred to as a front-arm-insertion groove 87 and the arm-insertion groove 72 positioned backward from the steering shaft 70 is referred to as a rear-arm-insertion groove 88. It is explained below in detail how the wheel arm 46 and the auxiliary wheel arm 47 are fitted to the hub 45.

As shown in FIG. 8 and FIG. 9, the wheel arm 46, whose both ends are inserted into the front-arm-insertion grooves 87 of both hubs 45, is fitted to both hubs 45 with the arm-fitted holes 73 and arm-fitting shafts 78 through the hub-connection holes 77 so that it can swing.

That is, the wheel arm 46, its both ends being fitted to both hubs 45 with the arm-fitting shafts 78 parallel to the steering shaft 70 so that it can swing, connects both front wheels 43 forward from the steering shaft 70 and moves together with both front wheels 43.

Further, as shown in FIG. 8 and FIG. 9, the auxiliary wheel arm 47, whose both ends are inserted into the rear-arm-insertion grooves 88 of both hubs 45, is fitted to both hubs 45 with the arm-fitted holes 73 and arm-fitting shafts 78 through the hub-connection holes 77 so that it can swing.

That is, the auxiliary wheel arm 47, its both ends being fitted to both hubs 45 with the arm-fitting shafts 78 parallel to the steering shaft 70 so that it can swing, connects both front wheels 43 backward from the steering shaft 70 and moves together with both front wheels 43.

Arm Joint 48

Further, as shown in FIG. 8, the above-mentioned arm joint 48 is constituted by a step-like-shaped bent part 79 to which a flat plate is bent and a cylindrical rod-shaped rotary shaft 80 which perpendicularly protrudes approximately from the center of the bent part 79. Further, a circular wheel-arm-connection hole 81 is formed in the vicinity of an end of the bent part 79 while a circular auxiliary-wheel-arm-connection hole 82 is formed in the vicinity of another end of the bent part 79.

Then, the arm joint 48, its rotary shaft 80 being inserted into the arm-joint-fitted hole 58 formed approximately in the center of the front-wheel-fitted part 52 of the base frame 42, is fitted to the base frame 42 so that it can rotate.

Further, as shown in FIG. 8, a cylindrical arm-joint-connection shaft 83, being inserted into the auxiliary-wheel-arm-connection hole 82 of the arm joint 48 and the center-connection hole 76 of the above-mentioned auxiliary wheel arm 47, is fitted to the arm joint 48 and the auxiliary wheel arm 47 so that it can rotate. Thus, the arm joint 48 and the auxiliary wheel arm 47 are made to move together.

Underbase 49

Figure 7A:
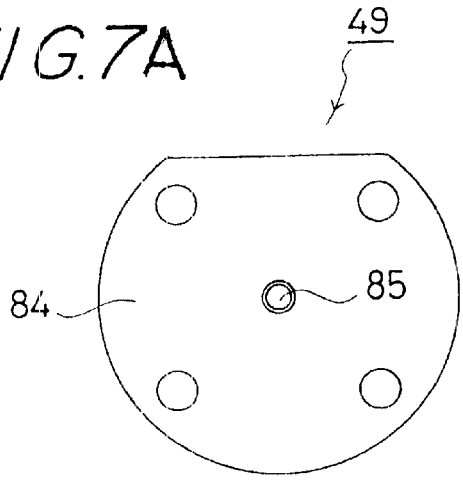
FIG. 7 contains a plan view (G), a back plan view (H) and a front view (I) of an underbase.
Figure 7C:
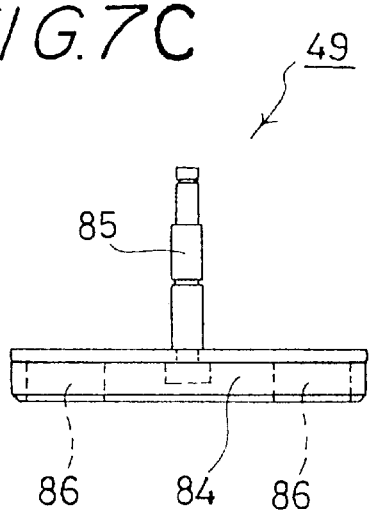
Figure 7B:
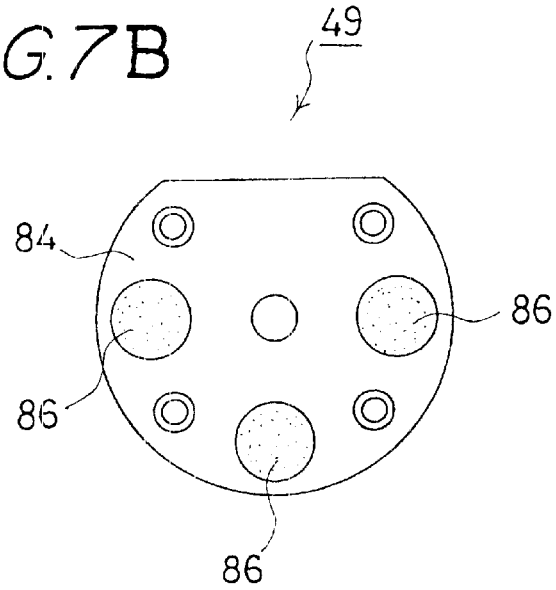

Further, as shown in FIGS. 7A–7C, the above-mentioned underbase 49 is constituted by a chipped-disc-shaped discal part 84, a cylindrical movable shaft 85 which perpendicularly protrudes approximately from the center of the discal part 84, and some magnets as obverse-side attraction means 86 embedded in a side of the discal part 84 opposite to the movable-shaft 85.

As shown in FIG. 8, the underbase 49 is disposed below the front-wheel-fitted part 52 of the base frame 42 and, its movable shaft 85 being inserted into the center-connection hole 76 of the above-mentioned wheel arm 46, is fitted to the wheel arm 46 so that it can rotate.

Further, as shown in FIG. 8, the movable shaft 85, being inserted into the wheel-arm-connection hole 81 of the arm joint 48, is also fitted to the arm joint 48 so that it can rotate, and then the arm joint 48 and the wheel arm 46 are made to move together.

Moreover, as shown in FIG. 8, the movable shaft 85, being inserted into the transversely-elongated hole 59 in the base frame 42, moves along the transversely-elongated hole 59, and then the underbase 49 can be made to move transversely relative to the base frame 42.

Thus, the mobile body 40 formed as above is placed on the obverse surface of the endless belt 20 and the reverse-side attraction means 31 of the guide body 30 and the obverse-side attraction means 86 of the mobile body 40 attract each other by a magnetic force. Therefore, the guide body 30 and the mobile body 40 are made to attract each other through the endless belt 20.

Movement

Subsequently, the movement of the playing machine according to the present embodiment is explained in detail.

Figure 10:
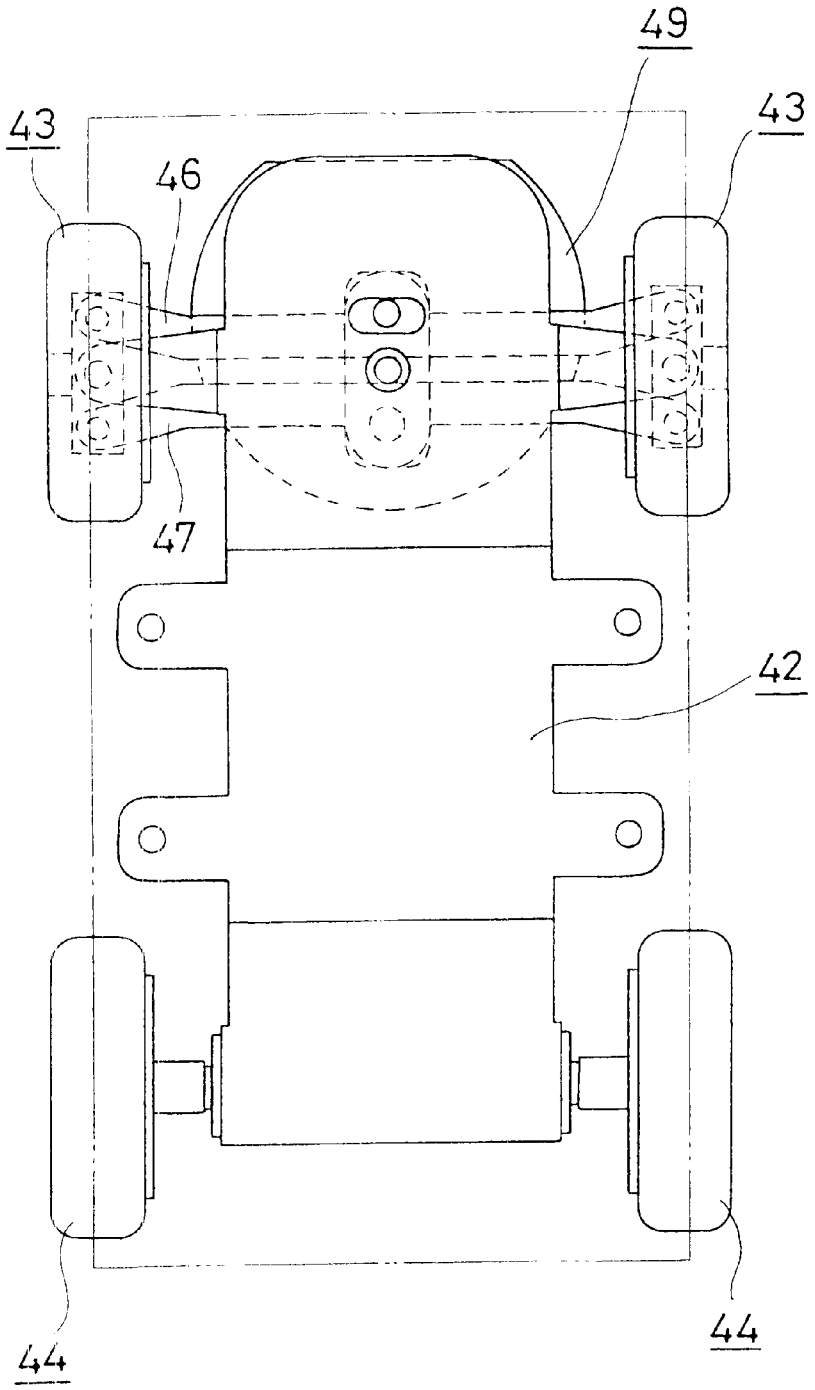
FIGS. 10 to 12 are plan views showing the operation of the mobile body.

As shown in FIG. 10, both front wheels 43 of the mobile body 40 usually parallel to a forward direction and so the mobile body 40 is made to run straight on the obverse surface of the endless belt 20.

Further, when the player moves the guide body 30, the mobile body 40 moves on the obverse surface of the endless belt 20 according to the movement of the guide body 30.

Figure 11:
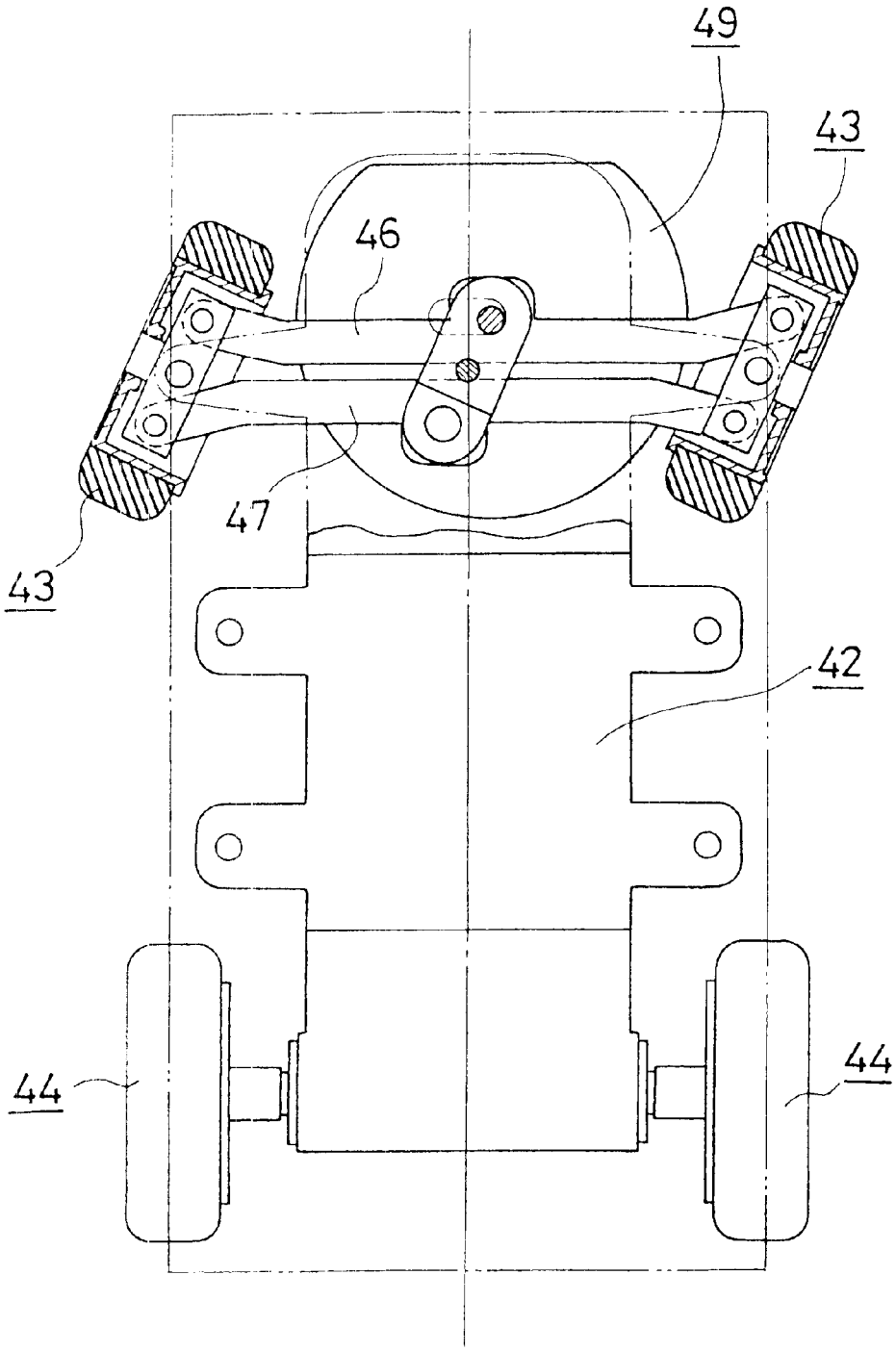
Figure 12:
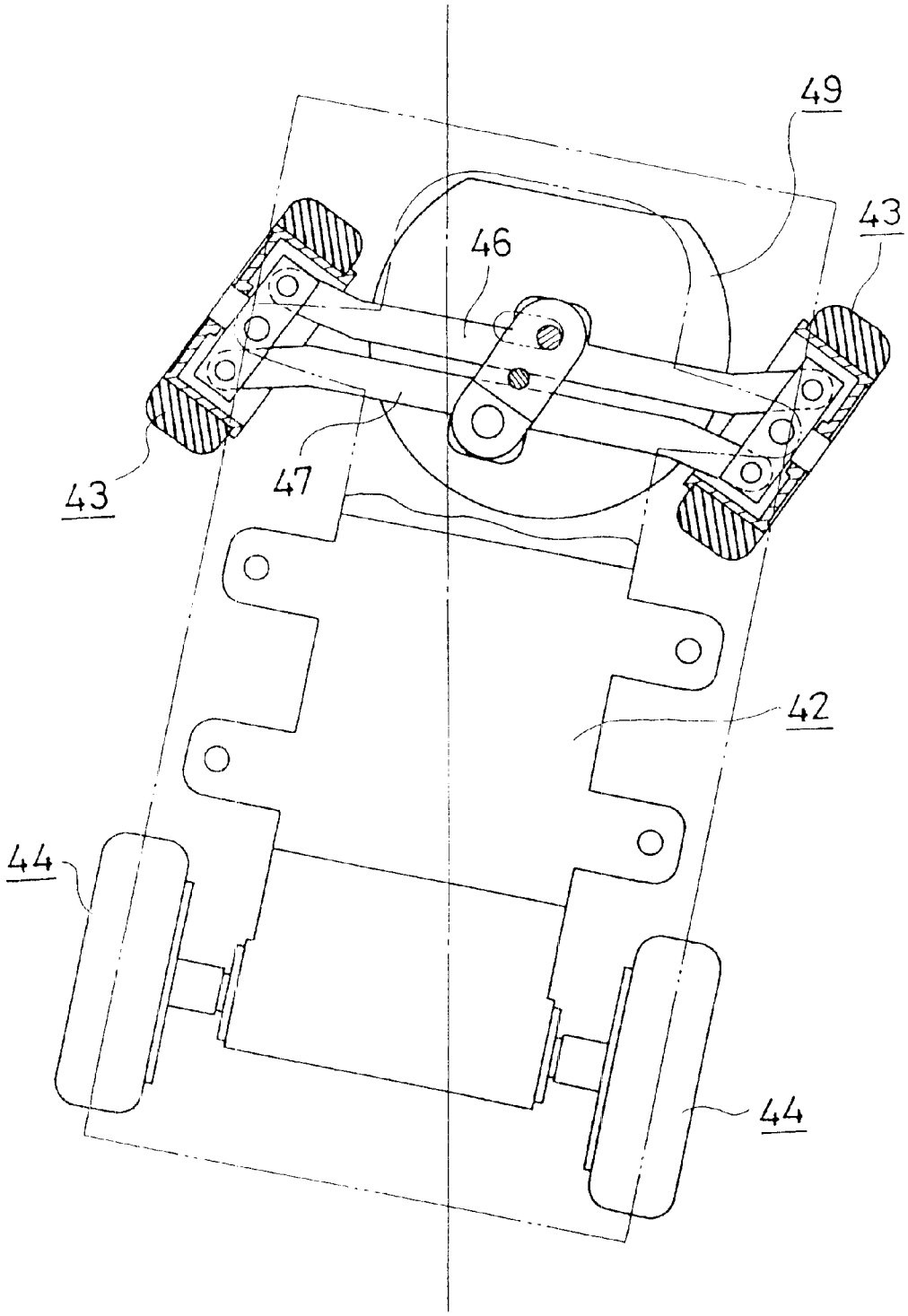

Concretely, when the player, turning the steering wheel 15, moves the guide body 30 embedded with the reverse-side attraction means 31 to the right, as shown in FIG. 11, the underbase 49 embedded with the obverse-side attraction means 86 and the wheel arm 46 first move to the right according to the movement of the guide body 30. Simultaneously, by both front wheels 43 which can turn transversely and both rear wheels 44 which can rotate without turning, both front wheels 43 of the mobile body 40 moving on the obverse surface of the endless belt 20 turn to the right, with their front parts moving to the right. Thus, thereafter, as shown in FIG. 12, according to the circulation of the endless belt 20, the whole mobile body 40 moves to the right corresponding to an advancing distance of the mobile body 30 against the endless belt 20.

Further, when the player, turning the steering wheel 15, moves the guide body 30 embedded with the reverse-side attraction means 31 to the left, of all, the underbase 49 embedded with the obverse-side attraction means 86 is and the wheel arm 46 first move to the left according to the movement of the guide body 30. Simultaneously, both front wheels 43 turn to the left. Thereafter, the whole mobile body 40 moves to the left according to the movement of the guide body 30.

In this way, in the playing machine, the front wheels 43 are made to turn to their moving direction as well as those of an actual automobile in order to show, with more reality, how the mobile body 40 runs.

Further, the playing machine has the wheel arm 46 to which both front wheels 43 are connected forward from the steering shaft 70 and which moves according to the swing of the front wheels 43 around the steering shaft 70. Moreover, the obverse-side attraction means 86 is fitted to the wheel arm 46 and thus the both front wheels 43 turn to their moving direction according to the movement of the obverse-side attraction means 86.

Therefore, by constituting the mechanism by which the front wheels 43 turn to their moving direction with relatively a few parts, the mobile body 40 can be manufactured easily, the manufacturing cost of the whole playing machine can be reduced and further the appearance of the playing machine can be improved.

INDUSTRIAL APPLICABILITY

As has been explained above, according to the present invention, the playing machine can be manufactured easily, the manufacturing cost of the whole playing machine can be reduced and further the appearance of the playing machine can be improved.

What is claimed is:

1. A playing machine comprising a circulating endless belt, a guide body which is provided at a reverse side of the endless belt and which is formed to be movable upon operation by a player, and a mobile body which is placed in an obverse surface of the endless belt and which is formed to model an automobile shape; wherein:

a reverse-side magnetically attractive element is mounted in a top of the guide body near to the mobile body;

an obverse-side magnetically attractive element is mounted in a bottom of the mobile body near to the guide body;

both the reverse-side magnetically attractive element mounted in the guide body and the obverse-side magnetically attractive element mounted in the mobile body are formed to attract each other through the endless belt;

the mobile body is formed to be movable on the obverse surface of the endless belt according to movement of the guide body upon the operation by the player;

the mobile body comprises a body, forward-facing front wheels located at two sides of the body which can swing around steering shafts perpendicular to the obverse surface of the endless belt, and a wheel arm to which the both front wheels are connected at positions forward from the steering shafts and which is formed to be movable according to the swing of the front wheels around the steering shafts; and the obverse-side magnetically attractive element is fitted to the wheel arm and is formed to be movable together with the wheel arm.

2. The playing machine of claim 1, wherein the front wheels are parallel to each other.

3. The playing machine of claim 1, wherein the obverse surface of the circulating endless belt includes a representation of a road.

4. The playing machine of claim 1, further comprising a driver configured to circulate the endless belt at different speeds.

5. The playing machine of claim 1, further comprising a driver configured to circulate the endless belt at different speeds, wherein the speed of the driver is controlled by an acceleration pedal and a braking pedal operated by the player.

6. The playing machine of claim 1, further comprising a steering wheel operatively coupled to the guide body.

7. The playing machine of claim 1, wherein only one of the reverse-side magnetically attractive element and obverse-side magnetically attractive element is a magnet.

8. The playing machine of claim 7, wherein the magnet is an electric magnet.

9. The playing machine of claim 7, wherein the magnet is a permanent magnet.

10. The playing machine of claim 1, wherein the circulating endless belt circulates on a driving roller, a guide roller, and a tension roller.

11. The playing machine of claim 1, wherein the front wheels are adapted to rotate about axles.

12. The playing machine of claim 11, wherein the front wheels are adapted to rotate both clockwise and counterclockwise.

13. The playing machine of claim 1, further comprising an outer casing.

14. The playing machine of claim 13, wherein the outer casing further comprises a window through which the player may view the mobile body and the circulating endless belt.

15. The playing machine of claim 1, further comprising two rear wheels located at either side of the body.

16. The playing machine of claim 15, wherein the rear wheels are adapted to rotate about axles.

17. The playing machine of claim 15, wherein the rear wheels are parallel to each other.

* * * * *